US010683074B2

(12) United States Patent
Davidson et al.

(10) Patent No.: US 10,683,074 B2
(45) Date of Patent: Jun. 16, 2020

(54) STEERING ASSEMBLY FOR A MARINE VESSEL WITH VERTICALLY OFFSET PROPULSION UNITS

(71) Applicant: Marine Canada Acquisition Inc., Richmond (CA)

(72) Inventors: Noam Davidson, Vancouver (CA); Richard Redfern, Delta (CA); Neal W. D. Wood, Coquitlam (CA)

(73) Assignee: Marine Canada Acquisition Inc., Richmond, CA (US)

( * ) Notice: Subject to any disclaimer, the term of this patent is extended or adjusted under 35 U.S.C. 154(b) by 0 days.

(21) Appl. No.: 13/873,173

(22) Filed: Apr. 29, 2013

(65) Prior Publication Data

US 2013/0284080 A1 Oct. 31, 2013

Related U.S. Application Data

(63) Continuation-in-part of application No. 13/071,874, filed on Mar. 25, 2011, now Pat. No. 8,430,702.

(51) Int. Cl.

| | |
|---|---|
| ***B63H 25/42*** | (2006.01) |
| ***B63H 20/12*** | (2006.01) |
| ***B63H 20/00*** | (2006.01) |

(52) U.S. Cl.

CPC ..... *B63H 25/42* (2013.01); *B63H 20/12* (2013.01); *B63H 2020/003* (2013.01)

(58) Field of Classification Search

CPC .. B63H 5/125; B63H 20/00; B63H 2020/003; B63H 20/08; B63H 20/10; B63H 20/12; B63H 25/22; B63H 25/42

USPC ..... 114/144 R; 440/61 R–61 C, 62, 63

See application file for complete search history.

(56) References Cited

U.S. PATENT DOCUMENTS

| | | | | |
|---|---|---|---|---|
| 4,300,888 | A * | 11/1981 | Warning | B63H 21/265 114/144 R |
| 4,836,812 | A | 6/1989 | Griffiths | |
| 5,002,510 | A | 3/1991 | Rump | |
| 5,092,801 | A | 3/1992 | McBeth | |
| 5,152,240 | A | 10/1992 | Fontanille | |
| 5,601,463 | A | 2/1997 | Kobelt | |
| 5,658,177 | A | 8/1997 | Wagner | |
| 5,934,956 | A | 8/1999 | Michel et al. | |
| 5,997,370 | A | 12/1999 | Fetchko et al. | |
| 6,044,674 | A | 4/2000 | Rushing et al. | |
| 6,224,438 | B1 * | 5/2001 | Hase | B63H 20/12 114/144 R |
| 6,261,139 | B1 | 7/2001 | Stiteler | |
| 6,322,408 | B1 | 11/2001 | Latham | |
| 6,406,340 | B1 * | 6/2002 | Fetchko et al. | 440/61 R |
| 6,913,497 | B1 | 7/2005 | Ahlswede et al. | |
| 7,207,854 | B1 * | 4/2007 | Anderson et al. | 440/63 |

(Continued)

*Primary Examiner* — Ajay Vasudeva

(74) *Attorney, Agent, or Firm* — Cameron IP

(57) ABSTRACT

A hydraulic steering system comprising a primary propulsion unit having a tiller, an auxiliary propulsion unit having a tiller, and a hydraulic steering actuator operatively coupled to the tiller of the primary propulsion unit. A tie bar couples a tie bar mount of the hydraulic steering actuator to the tiller of the auxiliary propulsion unit. A first connecting member which connects the tie bar to the tie bar mount of the hydraulic steering actuator and a second connecting member which connects the tie bar to the auxiliary propulsion unit are oriented substantially perpendicular to one another.

10 Claims, 14 Drawing Sheets

(56) References Cited

U.S. PATENT DOCUMENTS

| | | | | |
|---|---|---|---|---|
| 8,430,702 | B2 * | 4/2013 | Davidson et al. | 440/61 R |
| 2001/0048842 | A1 | 12/2001 | Schill | |
| 2005/0164572 | A1 | 7/2005 | Sasayama et al. | |
| 2006/0154535 | A1 | 7/2006 | Dudra et al. | |
| 2008/0026655 | A1 | 1/2008 | Gai et al. | |

* cited by examiner

STEERING ASSEMBLY FOR A MARINE VESSEL WITH VERTICALLY OFFSET PROPULSION UNITS

BACKGROUND OF THE INVENTION

Field of the Invention

The present invention relates to a steering assembly for a marine vessel and, in particular, to a steering assembly for a marine vessel with vertically offset propulsion units.

Description of the Related Art

Marine vessels are often provided with more than one propulsion unit. Typically tie bars are used to mechanically couple the propulsion units. U.S. Pat. No. 6,406,340 to Fetchko et al. and U.S. Pat. No. 7,128,626 to Dudra et al., the full disclosures of which are incorporated herein by reference in its entirety, both disclose using a tie bar to couple propulsion units on a marine vessel. This allows the propulsion units to be steered simultaneously.

It is also known to provide steering assemblies which accommodate vertically offset propulsion units. U.S. Pat. No. 6,699,082 to Zeiger et al., the full disclosure of which is also incorporated herein by reference in its entirety, discloses a steering assembly using spacers to accommodate vertical offsets between propulsion units. However, in the steering assembly disclosed by Zieger et al., the tie bars are connected to the propulsion units on a horizontal plane.

There is accordingly a need for an improved steering assembly for marine vessels with vertically offset propulsion units.

SUMMARY OF THE INVENTION

Some embodiments may provide an improved steering assembly for a marine vessel which has vertically offset propulsion units.

Some embodiments may provide a steering assembly having improved steering actuators provided with upwardly or downwardly extending tie bar mounts to reduce the slope of tie bars connecting adjacent, vertically offset propulsion units.

There is accordingly provided a hydraulic steering system comprising a primary propulsion unit having a tiller, an auxiliary propulsion unit having a tiller, and a hydraulic steering actuator operatively coupled to the tiller of the primary propulsion unit. The hydraulic steering actuator includes a cylinder and piston rod reciprocatingly mounted within the cylinder and extending through the cylinder for movement along a piston rod axis; a pair of spaced-apart cylinder arms extending radially outward of the cylinder and a pivot plate extending between the cylinder arms; a pair of support arms which are pivotable about a tilt axis and are connected to opposite ends of the piston rod to allow arcuate movement of the piston rod about the tilt axis while maintaining the piston rod axis parallel to the tilt rod axis; and a tie bar mount connected to the cylinder. A tie bar couples the tie bar mount of the hydraulic steering actuator to the tiller of the auxiliary propulsion unit, wherein a first connecting member which connects the tie bar to the tie bar mount of the hydraulic steering actuator and a second connecting member which connects the tie bar to the auxiliary propulsion unit are oriented substantially perpendicular to one another.

There is also provided a hydraulic steering system comprising a primary propulsion unit having a tiller, an auxiliary propulsion unit having a tiller, and a hydraulic steering actuator operatively coupled to the tiller of the primary propulsion unit. The hydraulic steering actuator includes a cylinder and piston rod reciprocatingly mounted within the cylinder and extending through the cylinder for movement along a piston rod axis; a pair of spaced-apart cylinder arms extending radially outward of the cylinder and a pivot plate extending between the cylinder arms; a pair of support arms which are pivotable about a tilt axis and are connected to opposite ends of the piston rod to allow arcuate movement of the piston rod about the tilt axis while maintaining the piston rod axis parallel to the tilt rod axis; and a clevis bracket connected to one of the cylinder arms. A tie bar couples the clevis bracket of the hydraulic steering actuator to the tiller of the auxiliary propulsion unit, wherein a first connecting member which connects the tie bar to the clevis bracket of the hydraulic steering actuator and a second connecting member which connects the tie bar to the auxiliary propulsion unit are oriented substantially perpendicular to one another.

BRIEF DESCRIPTIONS OF DRAWINGS

The invention will be more readily understood from the following description of the embodiments thereof given, by way of example only, with reference to the accompanying drawings, in which.

Figure 4:
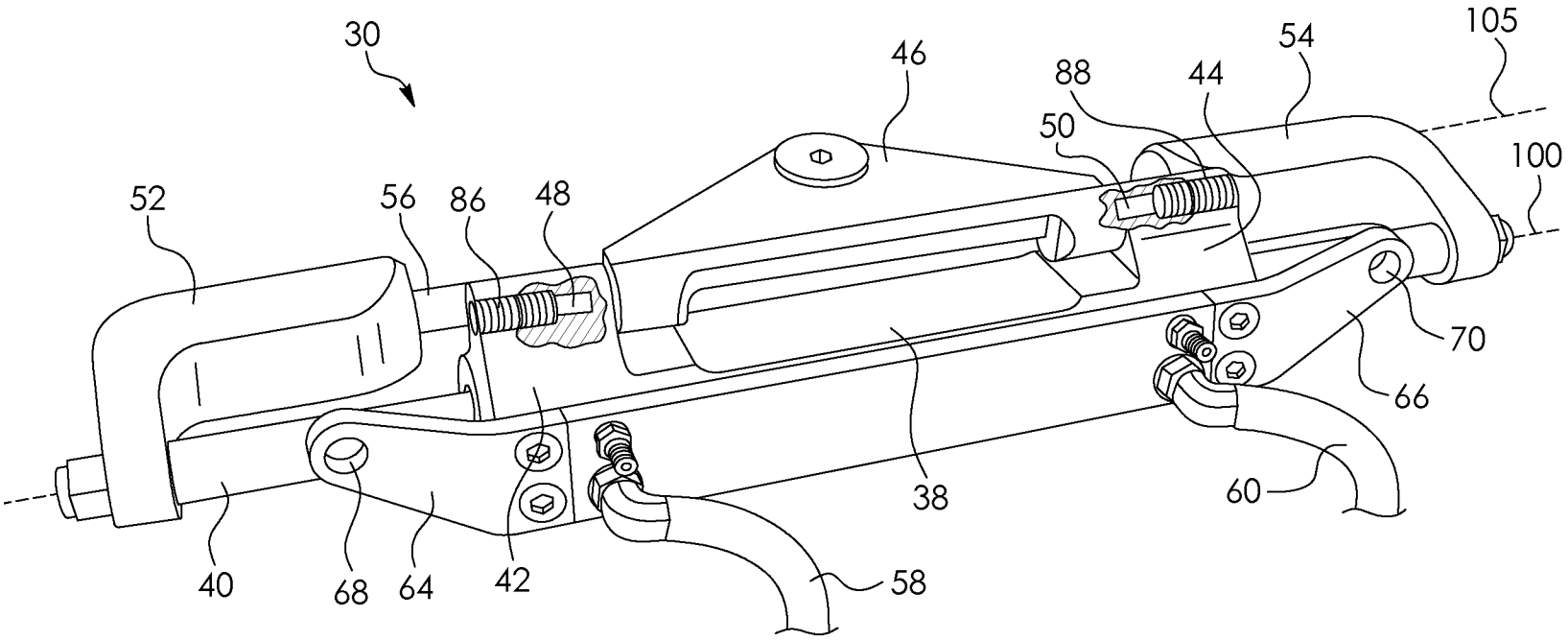
FIG. 4 is a perspective, partially broken away, view of a middle hydraulic steering actuator of the improved steering system.
Figure 4A:
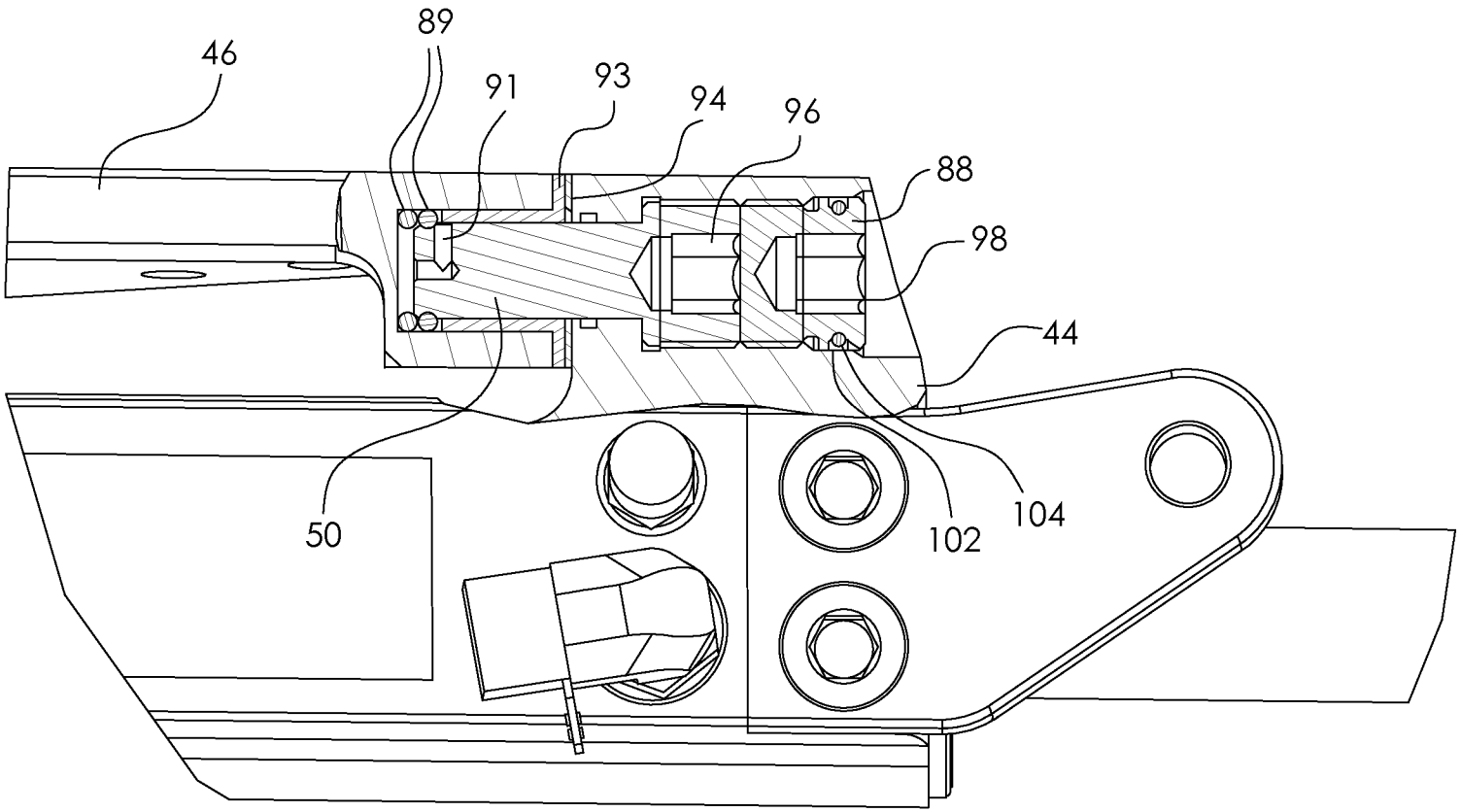
Figure 5:
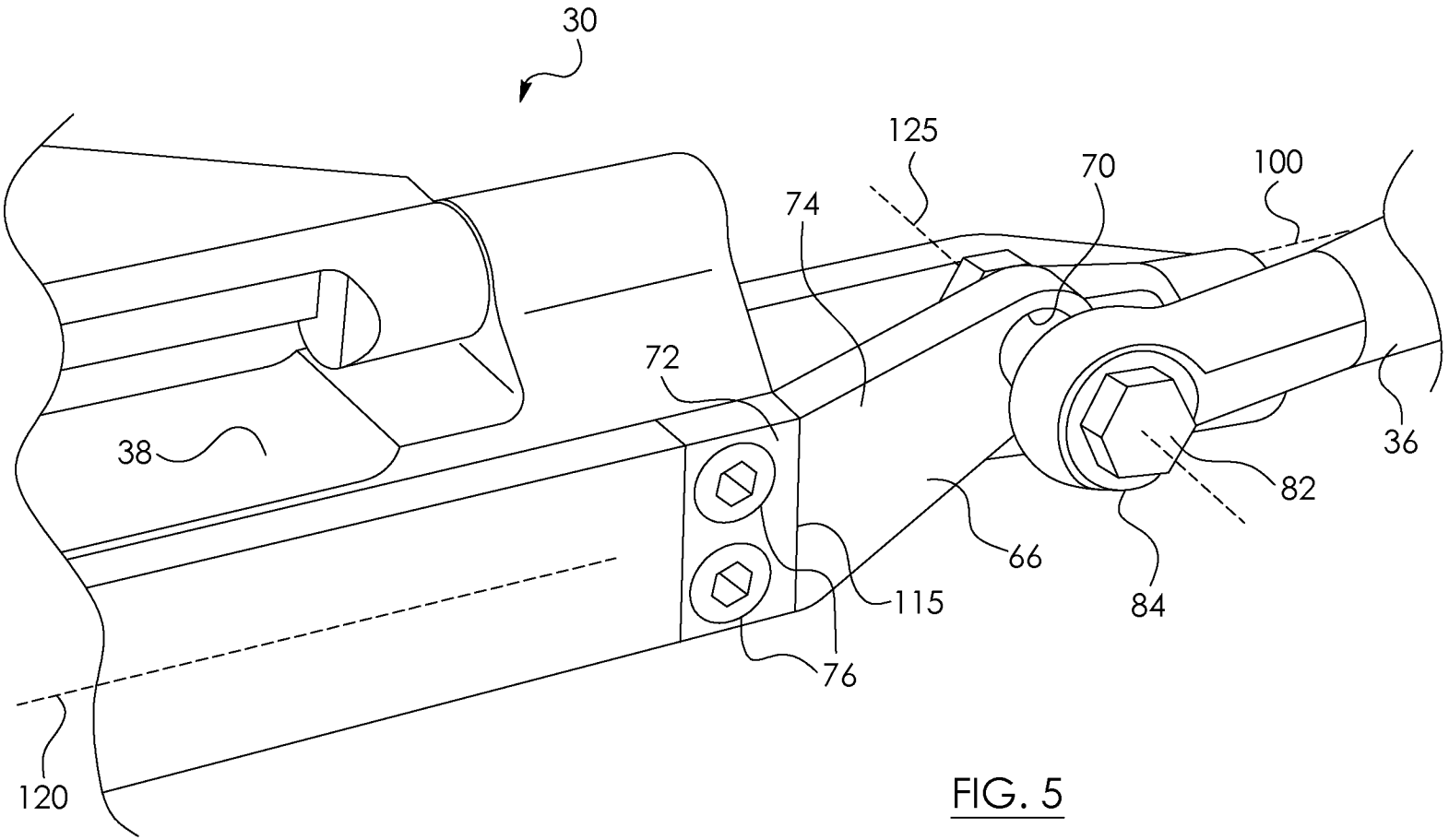
Figure 5A:
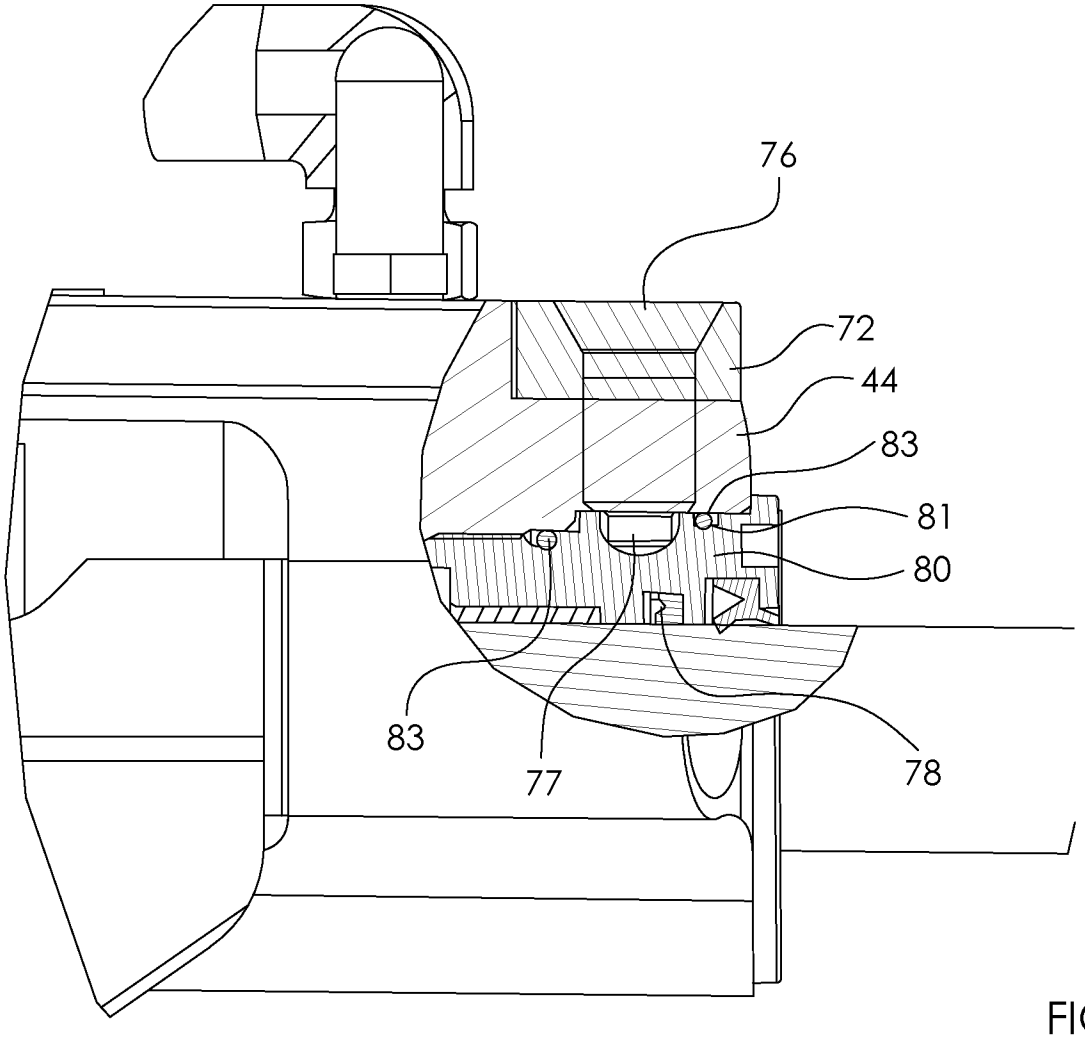
Figure 6:
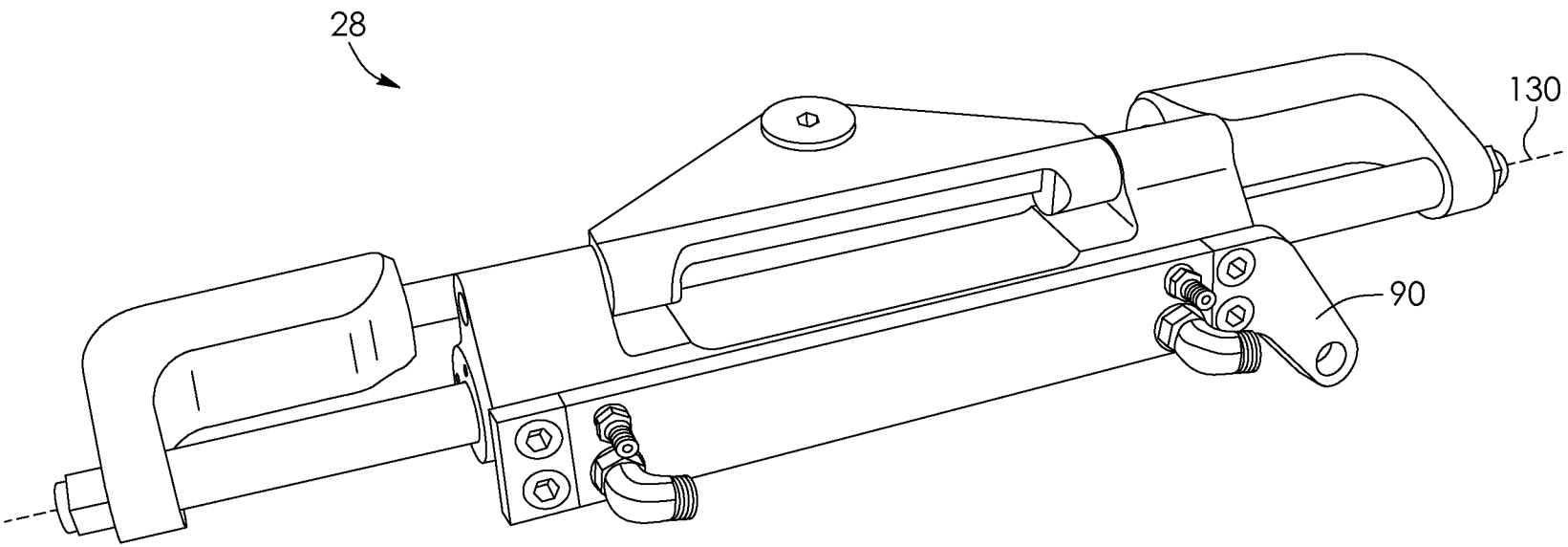
Figure 7:
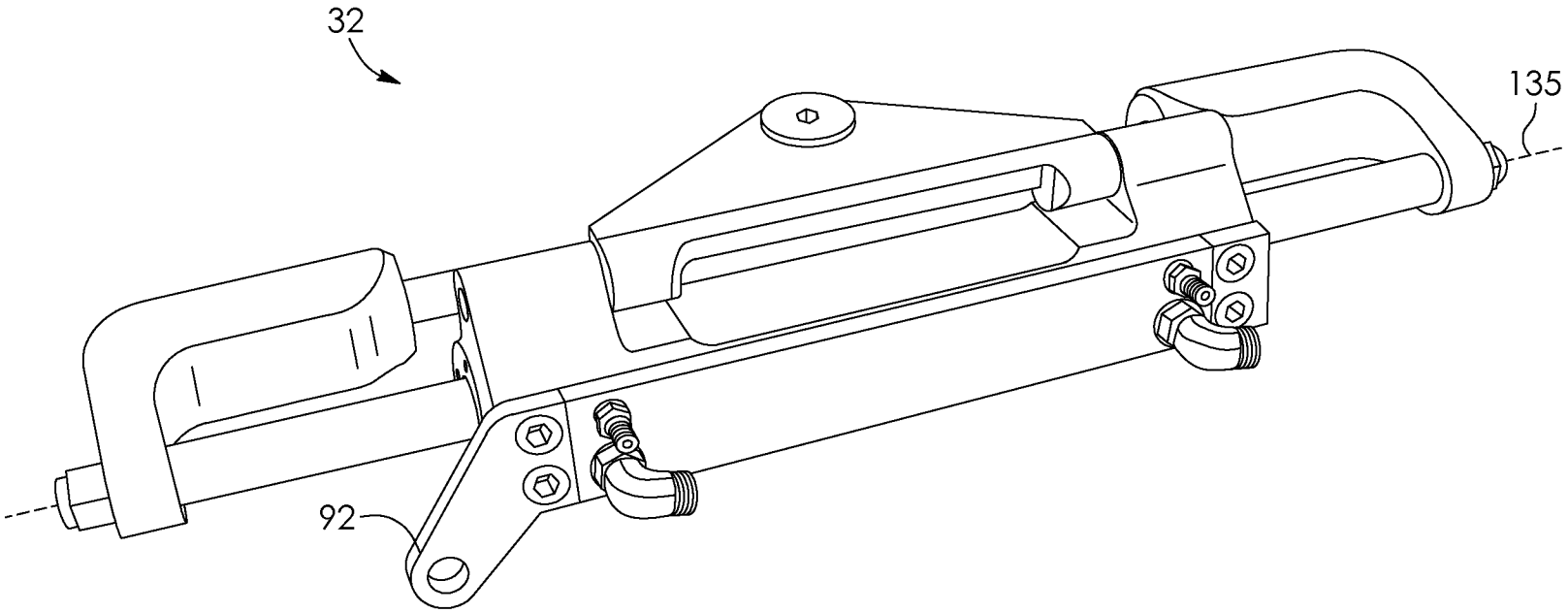
Figure 8:
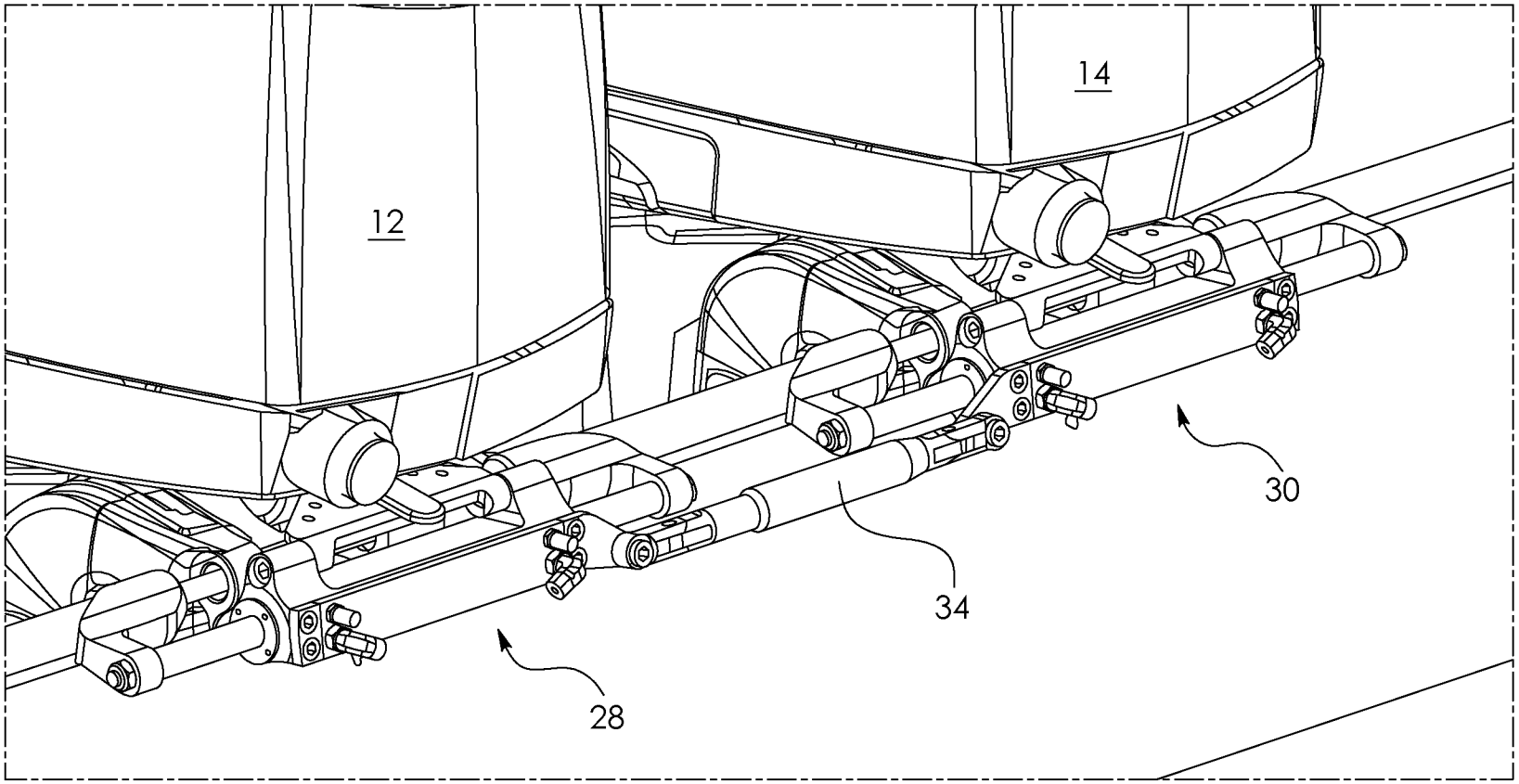
Figure 9:
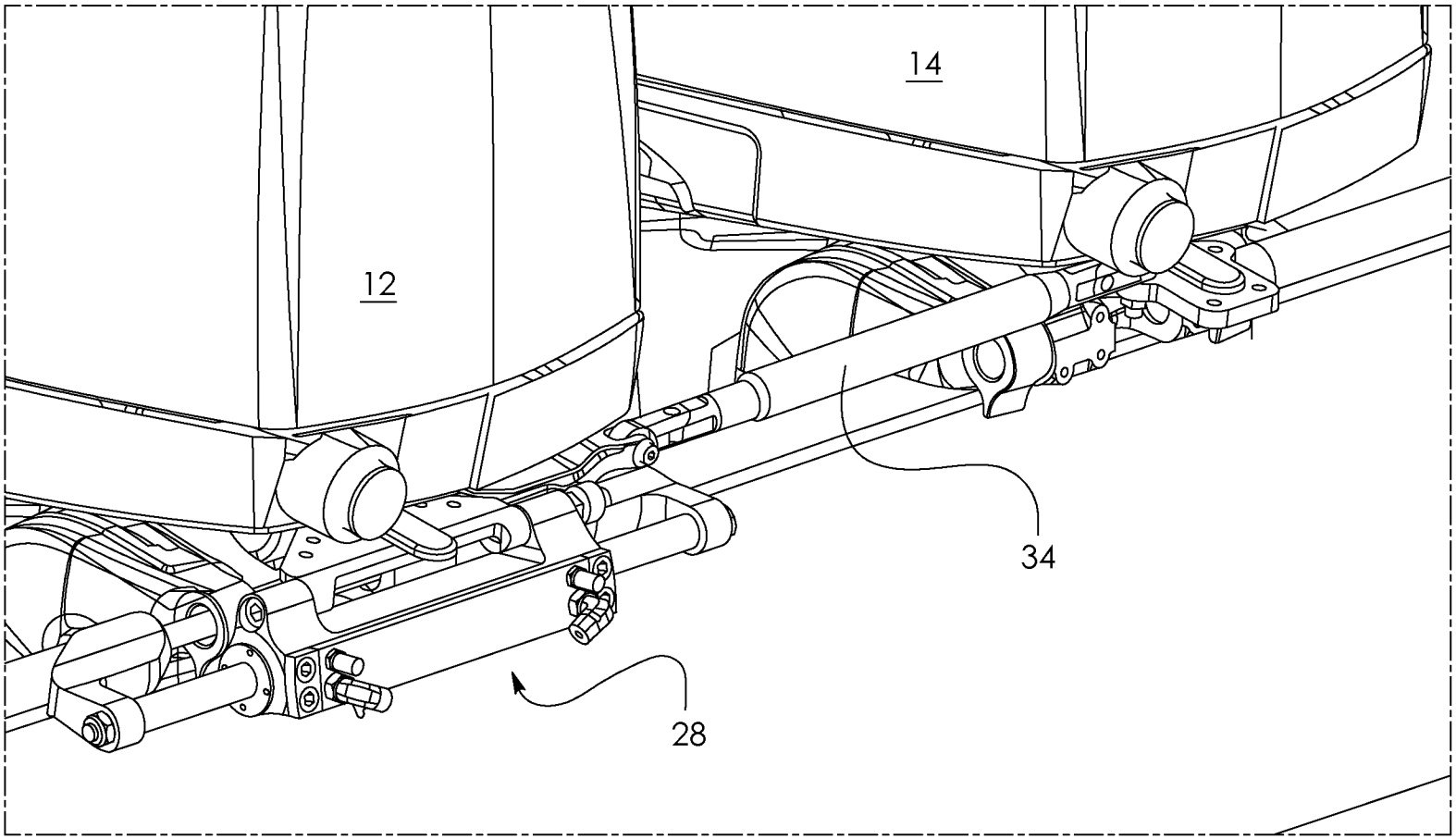
Figure 10:
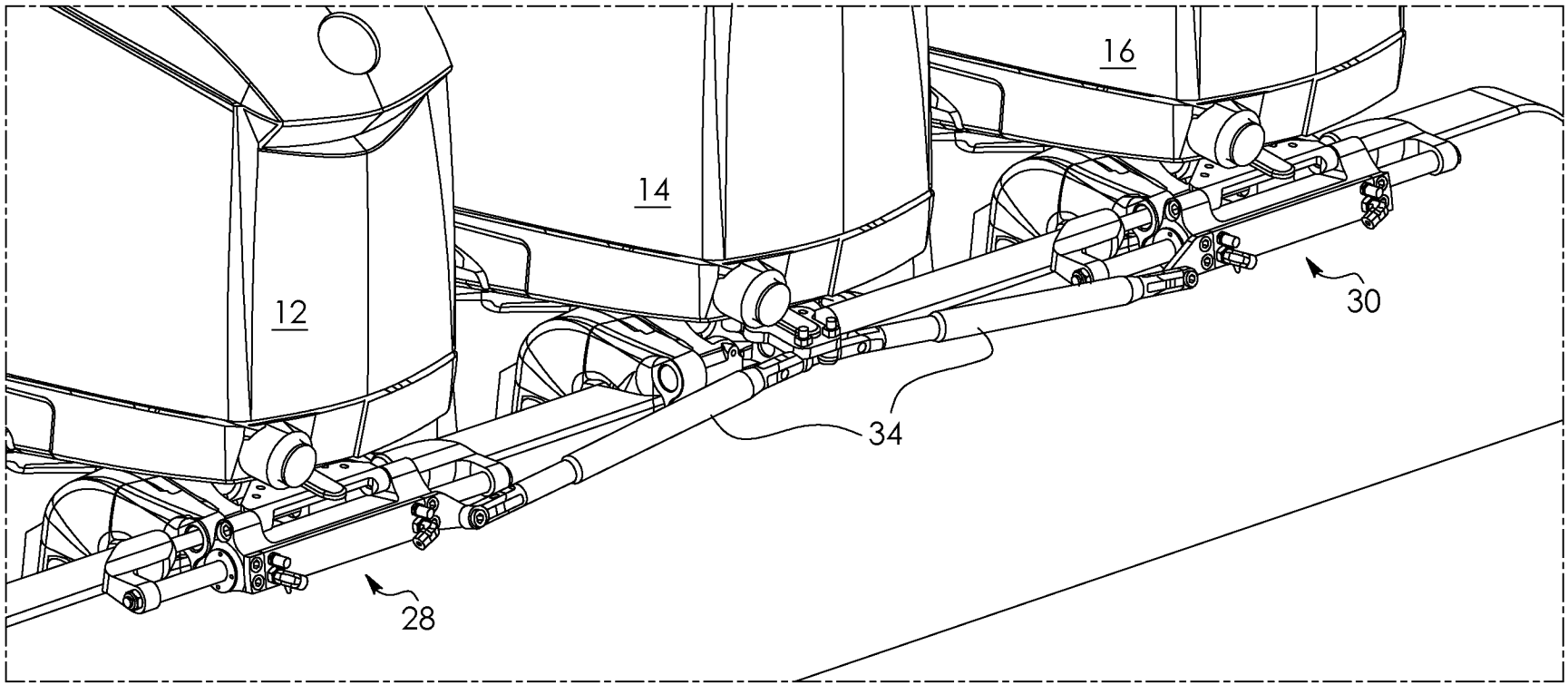
Figure 11:
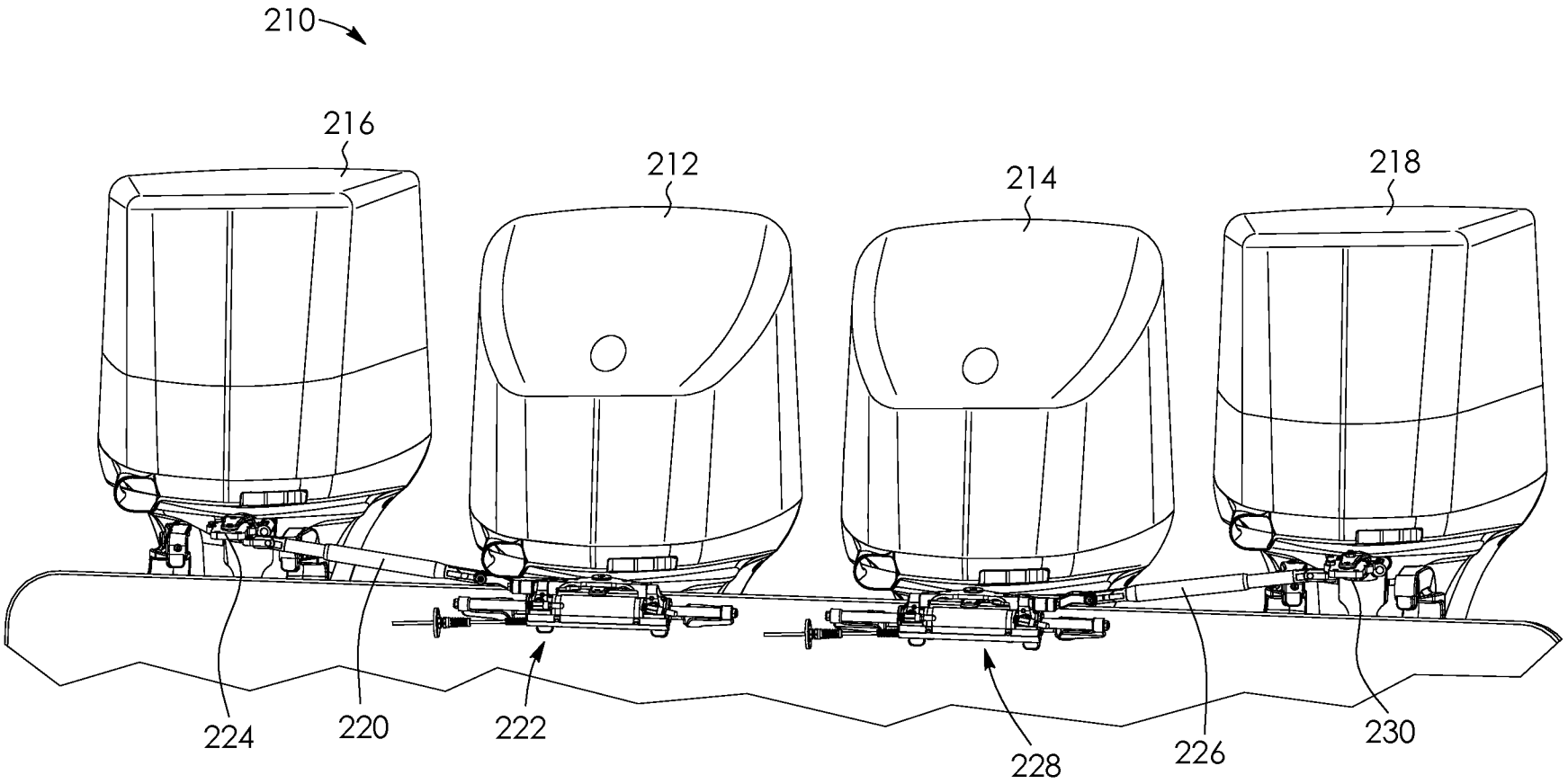
Figure 12:
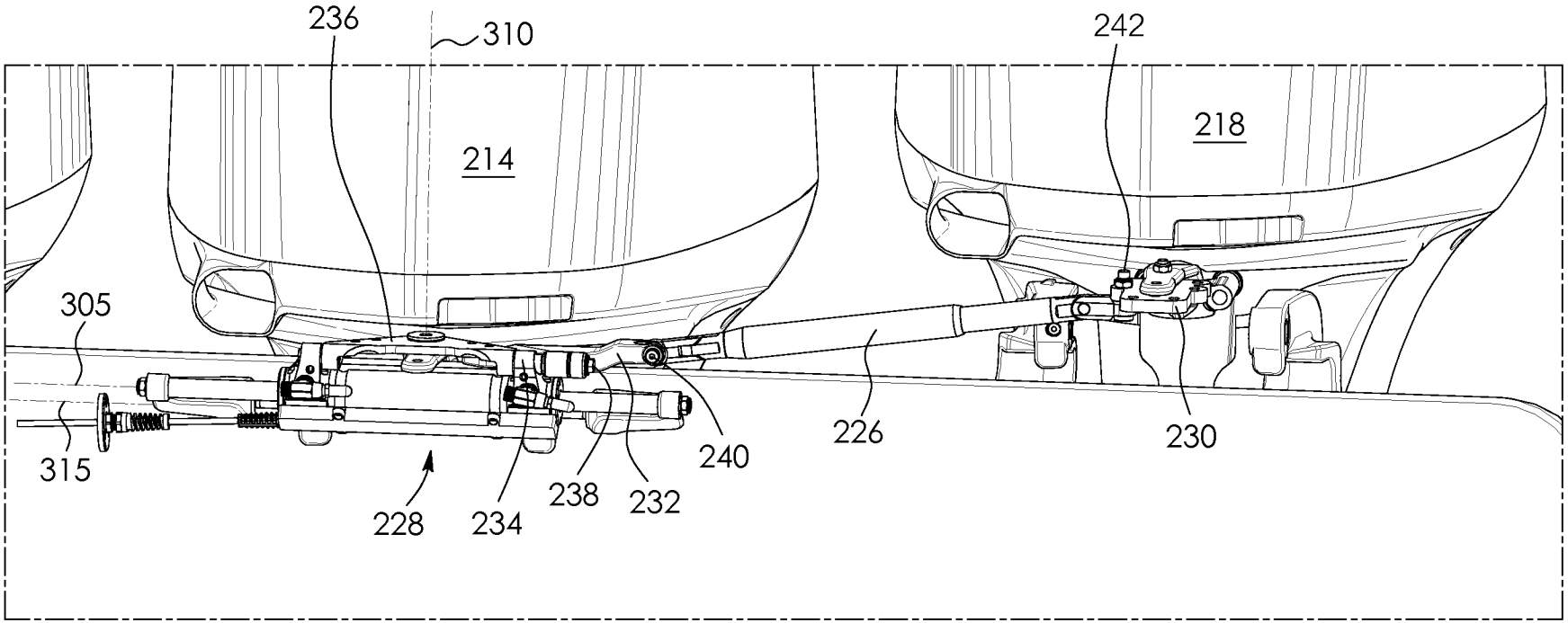

FIG. 4*a* is a partial cut away front view of the right side of a steering actuator similar to that shown in FIG. 4;

FIG. 5 is a view of the middle actuator of the improved steering system;

FIG. 5*a* is a partial broken away top view of the middle actuator of FIG. 5;

FIG. 6 is a perspective view of a starboard side hydraulic steering actuator of the improved steering system;

FIG. 7 is a perspective view of a port side hydraulic steering actuator of the improved steering system;

FIG. 8 is a partial perspective view of an improved steering system used with two propulsion units;

FIG. 9 is a partial perspective view of an alternate improved steering system used with two propulsion units;

FIG. 10 is a partial perspective view of an alternate improved steering system used with three propulsion units;

FIG. 11 is a perspective view of an alternate improved steering system used with four propulsion units; and FIG. 12 is a partial perspective view of port side propulsion units of the steering system of FIG. 11.

DESCRIPTIONS OF THE PREFERRED EMBODIMENTS

Figure 1:
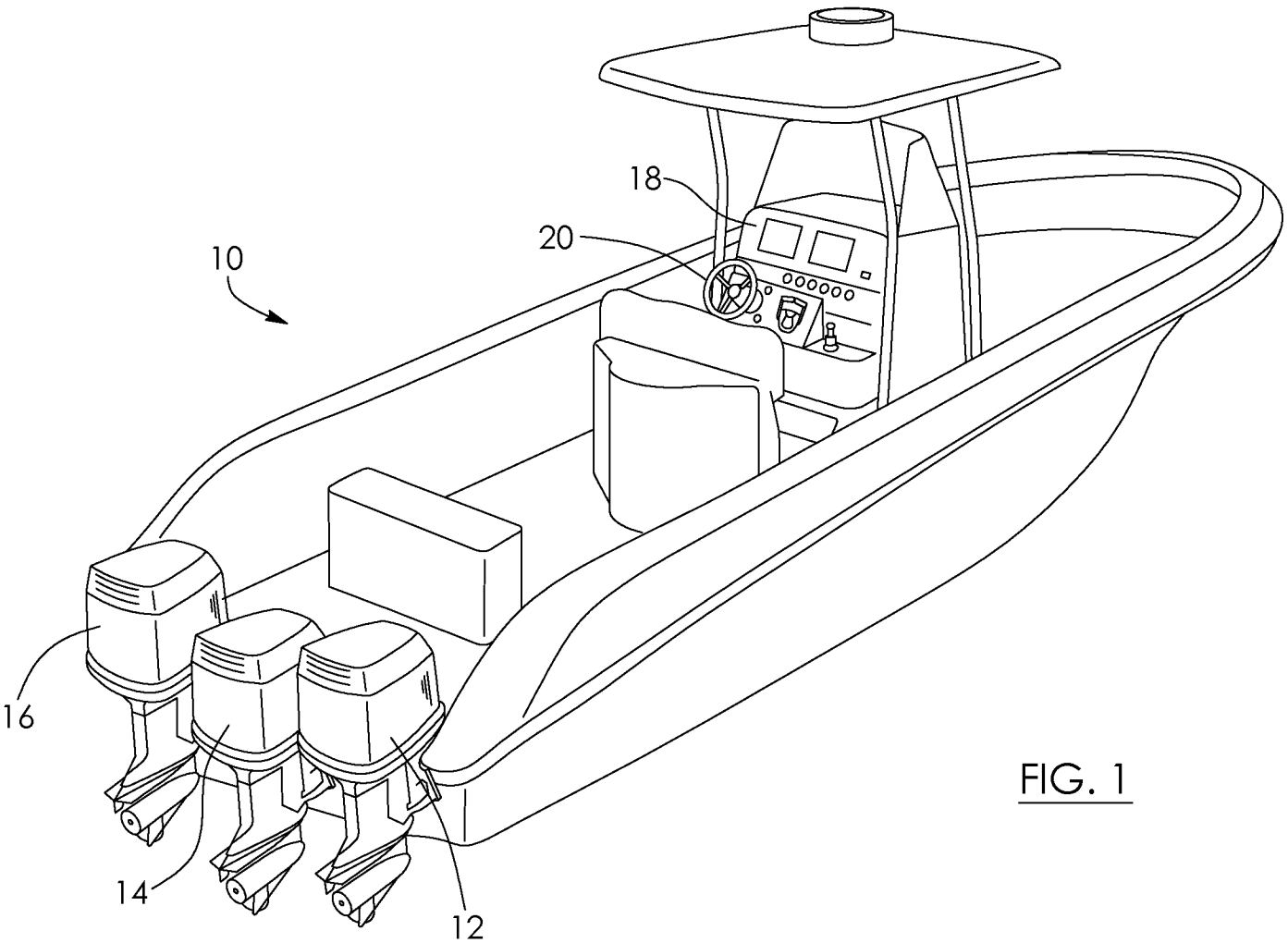
FIG. 1 is a perspective view of a marine vessel provided with a plurality of propulsion units and an improved steering assembly.

Referring to the drawings and first to FIG. 1, this shows a marine vessel 10 which is provided with a plurality of propulsion units in the form of three outboard engines 12, 14 and 16. However, in the other examples, the marine vessel 10 may be provided with any suitable number of inboard and/or outboard engines. It is common to see two engines and up to four engines in pleasure marine vessels. The marine vessel 10 is also provided with helm station 18 that includes a helm 20 for steering the marine vessel 10. The helm 20 is operatively connected to a helm pump (not shown) and is part of a hydraulic steering system which is used to steer the marine vessel 10.

Figure 2:
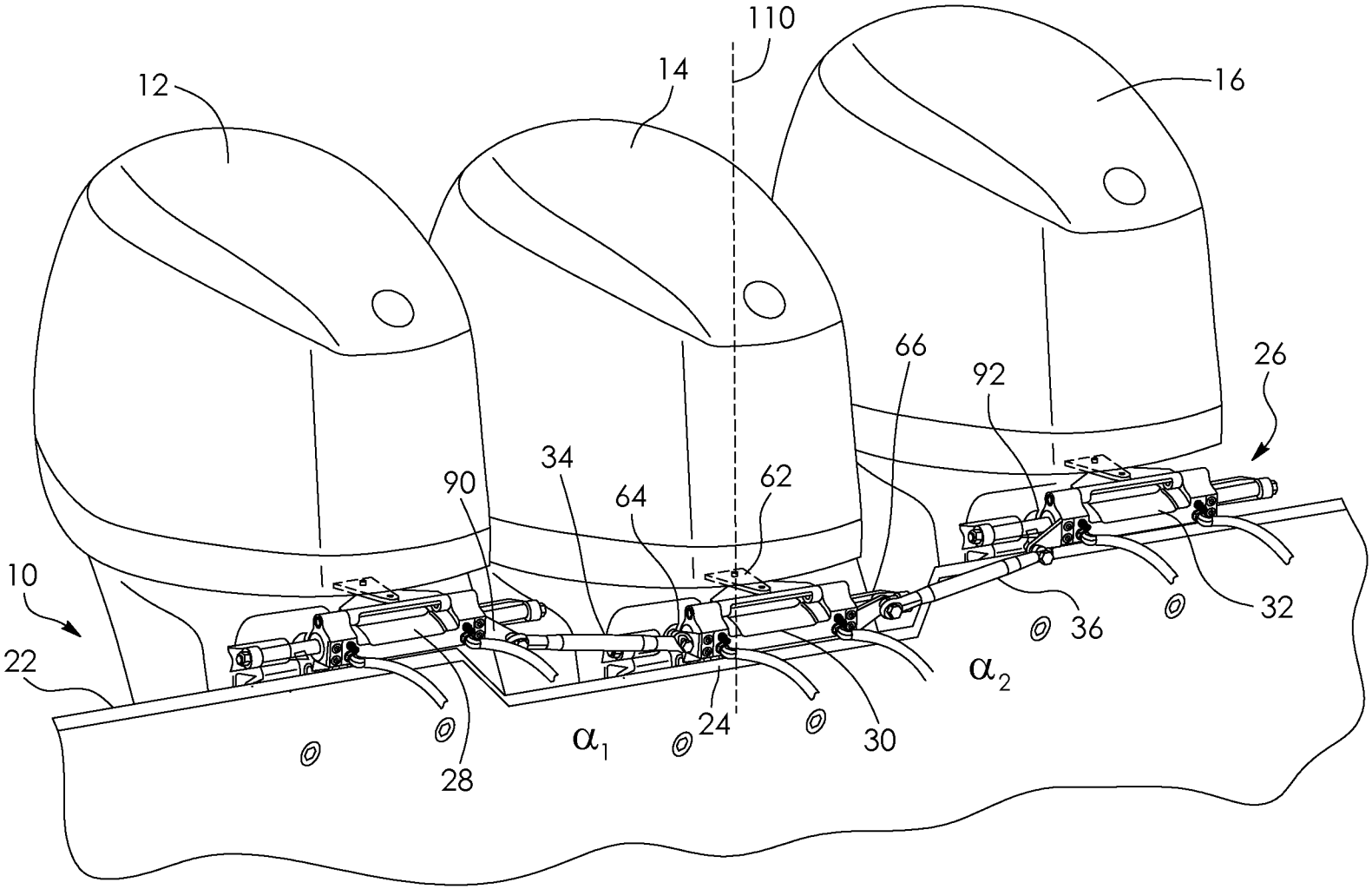
FIG. 2 is a perspective view of the improved steering system and propulsion units.

As best shown in FIG. 2, the engines 12, 14 and 16 are mounted on a transom 22 of the marine vessel 10, which is shown in fragment. The center engine 14 is mounted inside a centrally disposed, recessed portion 24 of the transom 22. The starboard and port side engines 12 and 16 are mounted on opposite sides of the transom 22 outside the recessed portion 24. The center engine 14 is accordingly vertically offset with respect to the starboard and port side engines 12 and 16. A steering assembly indicated generally by reference numeral 26 mechanically couples the engines. This allows the engines to be steered simultaneously. The steering assembly 26, better shown in FIG. 3, includes a plurality of steering actuators 28, 30 and 32 together with tie bars 34 and 36 which connect adjacent steering actuators. The steering actuators have a substantially similar structure and function in a substantially similar manner.

Figure 3:
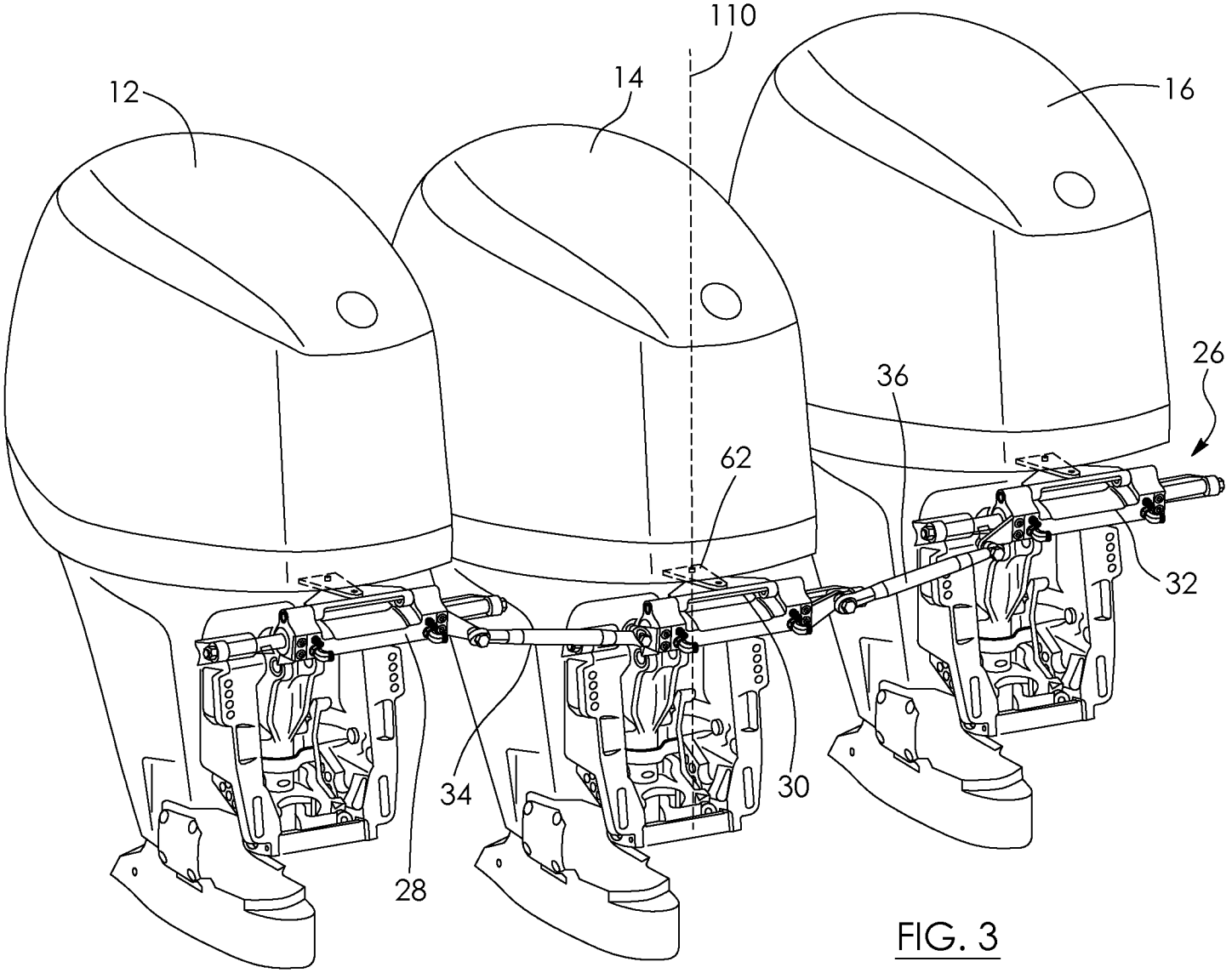
FIG. 3 is another perspective view of the improved steering system and propulsion units.

FIGS. 4 and 4*a* show the middle steering actuator 30 in greater detail. The middle steering actuator 30 includes a hydraulic cylinder 38 with a piston rod 40 reciprocatingly mounted therein allowing for relative movement of the cylinder 38 along a piston rod axis 100. The cylinder 38 has a pair of spaced-apart cylinder arms 42 and 44 which extend radially outward of the cylinder 38. A pivot plate 46 is pivotably connected to each of the cylinder arms 42 and 44 by pivot pins 48 and 50, respectively. The pivot plate 46 extends between the cylinder arms 42 and 44 and the cylinder arms may pivot about the pivot plate. Support arms 52 and 54 connect opposite ends of the piston rod 40 to a tilt rod 56 of a tilt tube (not shown) of the middle engine 14 which is shown in FIGS. 1 to 3. The support arms 52 and 54 restrict axial movement of the piston rod 40 relative to the marine vessel 10. The support arms 52 and 54 also allow arcuate movement of the cylinder 38 and piston rod 40, about a tilt axis 105, while maintaining the piston rod axis 100 parallel to the tilt axis 105.

Hydraulic conduits 58 and 60 hydraulically connect opposite ends of the cylinder 38 to the helm pump (not shown). Hydraulic fluid pumped from the helm pump actuates the cylinder 38 to reciprocate linearly relative to the piston rod 40. One of ordinary skill in the art will after reviewing this disclosure understand how the hydraulic fluid is pumped from the helm pump. In particular, the piston rod 40 remains axially stationary relative to the marine vessel 10, shown in FIG. 1, while the cylinder 38 reciprocates relative to the marine vessel 10.

Referring to FIG. 2, a steering member in the form of tiller 62 of the middle engine 14 is pivotably connected to the pivot plate 46 of the middle steering actuator 30. The relative linear movement of the cylinder 38 is thus transmitted to the tiller 62. This causes the tiller 62 to pivot about a steering axis 110 and the middle engine 14 to be steered. The starboard and port engines 12 and 16 are steered in a similar manner by the starboard and port side steering actuators 28 and 32. Furthermore, movement by any one of the steering actuators is transmitted by the tie bars 34 and 36 to the other ones of the steering actuators, allowing the engines to be steered simultaneously. As thus far described the steering assembly 26 and steering actuators 28, 30 and 32 are conventional.

However, as shown in FIGS. 4 and 4*a*, which is a partially cut away view similar to what is shown in FIG. 4, the middle steering actuator 30 is provided with asymmetrical tie bar mounts 64 and 66. The tie bar mounts 64 and 66 are each provided with an aperture 68 and 70, respectively. The apertures 68 and 70 extend axially in a direction generally perpendicular to the piston rod axis 100. The tie bar mounts 64 and 66 are substantially identical and one of the tie bar mounts 66 is shown in greater detail in FIGS. 5 and 5*a*. The tie bar mount 66 includes a first portion 72 and a second portion 74 which extends angularly from the first portion in an upwardly direction relative to the piston rod axis 100. In this example, the first portion 72 of the tie bar mount 66 has generally quadrilateral shape and the second portion 74 of the tie bar mount 66 has generally asymmetrical, curved shape. Broken line 115 represents the divide between the first portion 72 of the tie bar mount 66 and the second portion 74 of the tie bar mount 66.

As shown in FIGS. 5 and 5*a*, connecting members in the form of bolts 76 secure the tie bar mount 66 to the cylinder 38 of the middle steering actuator 30. The bolts 76 extend in a direction generally perpendicular to the piston rod axis 100. A projection 77 on the bolt 76 may engage a groove 78 in an end gland 80 of the cylinder 38. The end gland 80 may have grooves 81 to accommodate O-rings 83. The bolt 76 maintains the gland 80 in position and prevents the gland 80 from becoming decoupled from the cylinder 38 in response to frictional and vibratory forces during operation of the hydraulic steering system. Preferably, only a bolt 76 near a center line 120 of the cylinder 38 engages the groove 78 in the end gland 80. The center line 120 is typically coaxial with the piston rod axis 100 and the cylinder 38 is provided with grooved end glands at both ends thereof.

A connecting member in the form of bolt 82 extends through the aperture 70 in the tie bar mount 66 and a ball joint 84 in the tie bar 36. The bolt 82 connects the tie bar mount 66 to the tie bar 36, allowing the middle steering actuator 30 to be connected to the port side actuator 32 as shown in FIG. 2. The bolt 82 extends in a direction generally perpendicular to the piston rod axis 100 and allows the tie bar 36 to be connected to the tie bar mount 66 on a vertical plane so as to permit pivoting of the tie bar 36 about a generally horizontal axis 125 along the bolt 82. The ball joint 84 provides an articulate connection between the tie bar mount 66 and the tie bar 36. Other embodiments may use other articulating joints as the features described herein are not limited to ball joints only. The articulate connection allows the tie bar 36 to reciprocate along its longitudinal axis when the engines 12, 14 and 16 are moved back and forth as the marine vessel is steered. The middle steering actuator 30 is connected to the starboard side actuator 28 in a similar manner by tie bar mount 64 and tie bar 34.

Referring back to FIGS. 4 and 4*a*, the middle steering actuator 30 is further provided with a pair of set screws 86 and 88 which exert a compression force against the pivot pins 48 and 50, respectively. The set screws 86 and 88 provide a redundancy to maintain the pivot pins 48 and 50 in position. In other embodiments set screws may be used to provide a redundancy to maintain other pins or screws in position. For example, set screws may be used to provide a redundancy to maintain the bolts which secure the tie bar mounts to the cylinder in position.

FIG. 4*a* shows a right side of a middle hydraulic steering actuator of an improved steering system similar to that shown in FIG. 4. The tie bar mount 66 shown in FIG. 4*a* is slightly different than that shown in FIG. 4. One of ordinary skill in the art will understand that modifications to the system shown in the Figures may be done in accordance with the invention. As shown in FIG. 4*a*, O-rings 89 may be located near the pivot pin 50. The pivot pin 50 may have a passageway 91 in order to provide an escape pathway for grease, air and/or other materials. The pivot pin 50 may be fit in a flange bushing 93. In some embodiments the flange bushing 93 may be plastic although it is not limited to plastic. The flange bushing 93 may butt against a washer 94. The washer 94 may be stainless steel but is not limited to that material.

Both the pivot pin 50 and the set screw 88 may have structure 96, 98 to allow a tool to engage the pivot pin 50 and set screw 88 to turn them. In some embodiments the structure may be a hex broach 96, 98 as shown in FIG. 4*a* but it is not limited to hex broaches. The set screw 88 may have a groove 102 to accommodate an O-ring 104.

The starboard and port side steering actuators 28 and 32, best shown in FIGS. 6 and 7, are substantially similar in structure and function in a substantially similar manner as the middle steering actuator 30. However, the starboard side steering actuator 28 is provided with only one tie bar mount 90 which extends in a downwardly direction relative to its piston rod axis 130. Likewise the port side steering actuator 32 is provided with only one tie bar mount 92 which extends in a downwardly direction relative to its piston rod axis 135. The starboard side actuator 28 and port side actuators 32 are mirror images and are coupled to opposite sides of the middle actuator 30 by corresponding tie bars 34 and 36, as shown in FIGS. 2 and 3. There is an articulate connection between each of the tie bar mounts and the tie bars to allow the tie bars to rotate about their points of connection with the tie bar mounts when the engines 12, 14 and 16 are moved back and forth and/or tilted as the marine vessel 10 is steered.

As best shown in FIG. 2, providing the steering assembly 26 with upwardly and downwardly extending tie bar mounts 64, 66, 90 and 92 allows for improved mechanical coupling of the vertically offset engines 12, 14 and 16. In particular, the slope of tie bars 34 and 36 relative to the horizontal, as represented by angles $\alpha_1$ and $\alpha_2$, is reduced and in some embodiments the tie bars may be completely horizontal. In the embodiment of the steering assembly 26 disclosed herein the engines 12, 14 and 16 are vertically offset because the middle engine 14 is mounted in the recessed portion 24 of the transom 22. However, the steering assembly may also be used in situations where a vertical offset results because different types of engines are coupled, for example in a steering system including a primary propulsion unit and an auxiliary propulsion unit. The steering assembly may also be used in situations where there is no vertical offset. When there is no vertical offset the tie bar mounts all extend in the same direction.

FIGS. 8 to 10 show that various embodiments of the invention may be used with a number of different engine configurations and component configurations. For example, FIG. 8 is a partial perspective view of an improved steering system used with two propulsion units. FIG. 9 is a partial perspective view of an alternate improved steering system used with two propulsion units. FIG. 10 is a partial perspective view of an alternate improved steering system used with three propulsion units. The various Figures shown herein show alternate configurations of tie bars 34 and steering actuators 28, 30, 32. Various embodiments in accordance with the invention may use the configurations of tie bars 34 and steering actuators 28, 30, 32 shown or other variations. Additional numbers of propulsion units other than the three shown and the specific configurations shown may also be used in some embodiments of the invention.

FIG. 11 shows an alternative embodiment of a steering system 210 with four propulsion units, namely, a primary starboard side propulsion unit in the form of an outboard engine 212, a primary port side propulsion unit in the form of an outboard engine 214, an auxiliary starboard side propulsion unit in the form of a stern drive 216, and an auxiliary port side propulsion unit in the form of a stern drive 218. A tie bar 220 couples a steering actuator 222 of the starboard side outboard engine 212 to a steering member, or tiller 224, of the starboard side stern drive 216. The starboard side outboard engine 212 and stern drive 216 are vertically offset. Likewise a tie bar 226 couples a steering actuator 228 of the port side outboard engine 214 to a steering member, or tiller 230, of the port side stern drive 218. The port side outboard engine 214 and stern drive 218 are also vertically offset.

Referring now to FIG. 12, the steering actuator 228 of the port side outboard engine 214 is shown in greater detail. The steering actuator 228 is generally similar to that shown in FIG. 4 with the notable exception that the steering actuator 228 is not provided with asymmetrical tie bar mounts. Rather the steering actuator is provided with a clevis bracket 232 which is coupled to a cylinder arm 234 and pivot plate 236 of the steering actuator 228 by a bolt 238. The tie bar 226 is connected to the clevis bracket 232 by a connecting member in the form of a pivot pin 240 which extends substantially perpendicular to a piston rod axis 305, steering axis 310, and tilt axis 315 of the steering actuator 228. The tie bar 226 is connected to the tiller 230 of the port side stern drive 218 by a pivot pin 242 which extends substantially perpendicular to the piston rod axis 305 and tilt axis 315 of the steering actuator 228 but substantially parallel to a steering axis 310 of the steering actuator 228. Accordingly, the pivot pin 240 which couples the tie bar 226 to the steering actuator 228 of the port side outboard engine 214 extends substantially perpendicular to the pivot pin 242 which couples the tie bar 226 to the tiller 230 of the port side stern drive 218. It is the above described relative perpendicular orientations of the connecting members, or pivot pins 240 and 242, which allows the vertically offset propulsion units to be connected. It will be understood by a person skilled in the art that the starboard side outboard engine and stern drive have a similar structure and are coupled in a similar manner.

It will also be understood by a person skilled in the art that the terms "upwardly", and "downwardly" as used herein are used with reference to the upwardly and downwardly directions when the steering assembly is in use.

It will further be understood by a person skilled in the art that many of the details provided above are by way of example only, and are not intended to limit the scope of the invention which is to be determined with reference to following claims.

What is claimed is:

1. A hydraulic steering system for a marine vessel, the hydraulic steering system comprising:

a primary propulsion unit having a tiller;

an auxiliary propulsion unit having a tiller, the tiller of the auxiliary propulsion unit being mounted substantially vertically offset relative to the tiller of the primary propulsion unit;

a hydraulic steering actuator operatively coupled to the tiller of the primary propulsion unit, the hydraulic steering actuator including:

a cylinder having a pair of spaced-apart cylinder arms and a tie bar mount rigidly connecting thereto and a piston rod reciprocatingly mounted within the cylinder and extending through the cylinder for movement along a piston rod axis;

a pivot plate extending pivotably between the cylinder arms;

a pair of support arms which are pivotable about a tilt axis and are connected to opposite ends of the piston rod to allow arcuate movement of the piston rod about the tilt axis while maintaining the piston rod axis parallel to the tilt rod axis; and a tie bar coupling the tie bar mount of the cylinder to the tiller of the auxiliary propulsion unit, wherein a first connecting member which connects the tie bar to the tie bar mount of the cylinder and a second connecting member which pivotably connects the tie bar with the tiller of the auxiliary propulsion unit are oriented substantially perpendicular to one another.

2. The hydraulic steering system as claimed in claim 1 wherein the first connecting member extends in a direction substantially perpendicular to the tilt axis of the hydraulic steering actuator and in a direction substantially perpendicular to a steering axis of the hydraulic steering actuator.

3. The hydraulic steering system as claimed in claim 1 wherein the second connecting member extends in a direction substantially perpendicular to the tilt axis of the hydraulic steering actuator and in a direction substantially parallel to a steering axis of the hydraulic steering actuator.

4. The hydraulic steering system as claimed in claim 1 wherein the tie bar mount extends in an upwardly direction relative to the piston rod axis.

5. The hydraulic steering system as claimed in claim 1 wherein the tie bar mount extends in a downwardly direction relative to the piston rod axis.

6. A hydraulic steering system for a marine vessel, the hydraulic steering system comprising:

a primary propulsion unit having a tiller;

an auxiliary propulsion unit having a tiller, the tiller of the auxiliary propulsion unit being mounted substantially vertically offset relative to the tiller of the primary propulsion unit;

a hydraulic steering actuator operatively coupled to the tiller of the primary propulsion unit, the hydraulic steering actuator including:

a cylinder having a pair of spaced-apart cylinder arms, a clevis bracket connected to one of the cylinder arms and a piston rod reciprocatingly mounted within the cylinder and extending through the cylinder for movement along a piston rod axis;

a pivot plate extending between the cylinder arms;

a pair of support arms which are pivotable about a tilt axis and are connected to opposite ends of the piston rod to allow arcuate movement of the piston rod about the tilt axis while maintaining the piston rod axis parallel to the tilt rod axis; and a tie bar coupling the clevis bracket of the cylinder to the tiller of the auxiliary propulsion unit, wherein a first connecting member which connects the tie bar to the clevis bracket of the cylinder and a second connecting member which pivotably connects the tie bar with the tiller of the auxiliary propulsion unit are oriented substantially perpendicular to one another.

7. The hydraulic steering system as claimed in claim 6 wherein the first connecting member extends in a direction substantially perpendicular to the tilt axis of the hydraulic steering actuator and in a direction substantially perpendicular to a steering axis of the hydraulic steering actuator.

8. The hydraulic steering system as claimed in claim 6 wherein the second connecting member extends in a direction substantially perpendicular to the tilt axis of the hydraulic steering actuator and in a direction substantially parallel to a steering axis of the hydraulic steering actuator.

9. The hydraulic steering system as claimed in claim 6 wherein the tie bar mount extends in an upwardly direction relative to the piston rod axis.

10. The hydraulic steering system as claimed in claim 6 wherein the tie bar mount extends in a downwardly direction relative to the piston rod axis.

* * * * *